United States Patent [19]

Dinan et al.

[11] 4,095,360

[45] Jun. 20, 1978

[54] DISPLAY DEVICE

[75] Inventors: James M. Dinan, Irvington; Conrad Hade, Rye, both of N.Y.; Frank De Nigris, Parsippany, N.J.

[73] Assignee: Dinaco, Inc., New York, N.Y.

[21] Appl. No.: 680,895

[22] Filed: Apr. 27, 1976

[51] Int. Cl.[2] ..... G09F 7/22

[52] U.S. Cl. ..... 40/603; 40/10 D; 40/613; 40/159

[58] Field of Search ..... 40/125 G, 125 H, 125 R, 40/128, 125 F, 125 N, 145 R, 145 A, 159, 104.19, 124.2, 10 D, 138, 10 R, 10 A, 10 B

[56] References Cited

U.S. PATENT DOCUMENTS

| | | | |
|---|---|---|---|
| 1,674,565 | 6/1928 | Peterson | 40/125 G X |
| 1,750,118 | 3/1930 | Mueller et al. | 40/138 |
| 3,466,774 | 9/1969 | Borresen | 40/159 X |
| 3,609,894 | 10/1971 | Miller | 40/125 G X |
| 3,612,460 | 10/1971 | Smith | 40/125 H X |
| 3,866,648 | 2/1975 | Anderson | 40/159 X |

*Primary Examiner*—John F. Pitrelli
*Attorney, Agent, or Firm*—Spellman & Joel

[57] ABSTRACT

A display device comprises a rectangular transparent plastic envelope formed from two sheets of flexible plastic material which are seamed together adjacent their top, one side and bottom margins. The sheets also include horizontal enclosed sleeves at the top and bottom of the envelope in which tubular arms are located. Flexible coupling means are provided in engagement with the upper tubular arm while the lower tubular arm is engaged by laterally spaced tension means which permit the lower arm to turn ninety degrees with respect to the upper arm. A zipper-type closure means may be provided along the open side of the envelope to removably seal the envelope.

6 Claims, 8 Drawing Figures

DISPLAY DEVICE

BACKGROUND OF THE INVENTION

The present invention relates to a display device and is more particularly concerned with a display device for use in gasoline service stations.

The invention is particularly concerned with a display device especially useful for mounting temporary advertising messages outdoors in the service station in locations where the message is readily noticed by customers in the service station and passing motorists. Such advertising messages are mounted on display racks and in large numbers on what is known in the trade as "pole signs". It is highly desirable that such signs can be readily replaced to display current advertising messages and that the display device and the means of carrying the advertising message be available at low cost and mounted and changed conveniently and with no special tools.

Because of the outdoor location of such advertising displays, they must be resistant to weather themselves or protected from the effects of weather by means associated with the display devices.

Another important consideration in the design of such display devices is, because of the temporary nature of the display panels, they are often of relatively light construction; for example, heavy laminated paper or cardboard which is clamped into various sign frames. One of the most significant problems which must be considered in such signs is the relatively large size of the display panel required to make the sign readable to passing motorists and attract attention and the consequent effect that wind has on the panel. In the case of many of the display devices presently available on the market, they are easily permanently twisted out of the desired orientation or, if mounted so firmly as not to give or turn in the wind, they are destroyed by a gust of wind which tears the laminated panels. In addition, most of the devices designed for the display of temporary messages make no suitable provision for protecting the surface of the message display from the elements.

While the problem of durability and exposure to the weather can be minimized by using painted metal display panels, this, of course, greatly adds to the cost of the material and defeats the objectives of readily changing advertising messages to coincide with current promotions. In addition, the utilization of metal panels requires heavier support elements and should the sign break loose in the wind, the danger of injury to passers-by is significant. It is furthermore highly desirable that such display devices be capable of displaying an advertising message readily on both sides of the display device. Further it is highly desirable that it be possible to change the advertising message or panel without disassembling the display device itself or, as in the case of some current devices, partially destroying the display device.

Further, it is extremely important that devices of this type in which there is a relatively large surface area be capable of yielding to wind gusts, i.e. either fully or at least to partially orient the plane of the panel to the direction of the strong wind and then immediately return to the predetermined orientation when the wind decreases. It is also desirable that the surface panel itself be flexible in order to absorb the stresses of light breezes so that the "dumping" effect does not take place except in higher winds or gusts. It is also desirable, because of the cost and often limited areas suitable for mounting advertising messages in a service station, that a display device be adaptable to mounting or displaying a plurality of panels with the advertising indicia carried thereon and that the same device be capable of displaying the advertising messages in two opposing directions.

The present invention provides a display device which meets all of the foregoing considerations. As will be seen, it is convenient to use, low is cost, provides protection from the elements for the panel or poster displaying the advertising message, provides for "dumping" in high winds and a flexibility in light breezes. In addition, the design provides for the convenient display of multiple advertising panels on both sides of the sign.

SUMMARY OF THE INVENTION

The display device of the present invention consists of a rectangular transparent plastic envelope formed from two sheets of transparent flexible plastic such as polyurethane which are seamed together adjacent their top, one side and bottom margins. At both the top and the bottom of the envelope thus formed is a sleeve dimensioned so as to receive a tubular arm. In use, the envelope is mounted in a vertical position between the two tubular arms, each of which is mounted horizontally and parallel to the other as described below. One side of the envelope is provided with a closure extending from the top of the envelope to the bottom of the envelope. The closure may be a conventional zipper lock or any equivalent closure means. The envelope provides a protected enclosure for the display of advertising messages on cardboard panels which are inserted in the envelope. The messages can be displayed on both the front and the back and thus at least two messages displayed from the single envelope. In the preferred embodiment, a plurality of pockets are formed within the envelope, usually two, by seaming the envelope horizontally across the center thereof to form an upper and lower pocket.

The sleeve at the top of the envelope has the central portion thereof cut out in order to accommodate a flexing coupling. The tubular arms at the top and the bottom of the envelope are preferably formed with a rectangular cross section. The tubular arm at the top is inserted halfway through the sleeve and then passes through the lower portion of a flexing coupling described below and thence through the remainder of the top sleeve. The upper portion of the flexing coupling is also provided with channels through which a pole mounting frame passes, the frame being secured to a pole or the like by conventional mounting means. The lower horizontal arm is provided with means to spill wind and memory to return to normal position. In the preferred embodiment illustrated, there is shown two coil springs spaced apart the center thereof, the upper ends of which are inserted in spaced apart apertures in the lower horizontal arm, and the other ends of which are placed in corresponding apertures in the mounting frame. A flexing coupling as at the top may also alternatively be employed. The springs are tensioned so that they will yeild only to forces generated by higher wind gusts so that the horizontal bar is capable of turning 90° to the upper horizontal bar in order to "dump" the display envelope in high winds but not to permit turning of the pouch in light breezes.

The display device of the present invention is low in cost and extremely convenient to use. No unusual tools are required to erect it. It is easily transported in small packages. The message panels are protected from exposure to the weather and can be changed easily by simply opening the zipper closure and removing the old and inserting the new panel.

BRIEF DESCRIPTION OF THE DRAWING

In the accompanying drawing which forms a part of the specification.

DETAILED DESCRIPTION OF THE PREFERRED EMBODIMENTS

Figure 1:
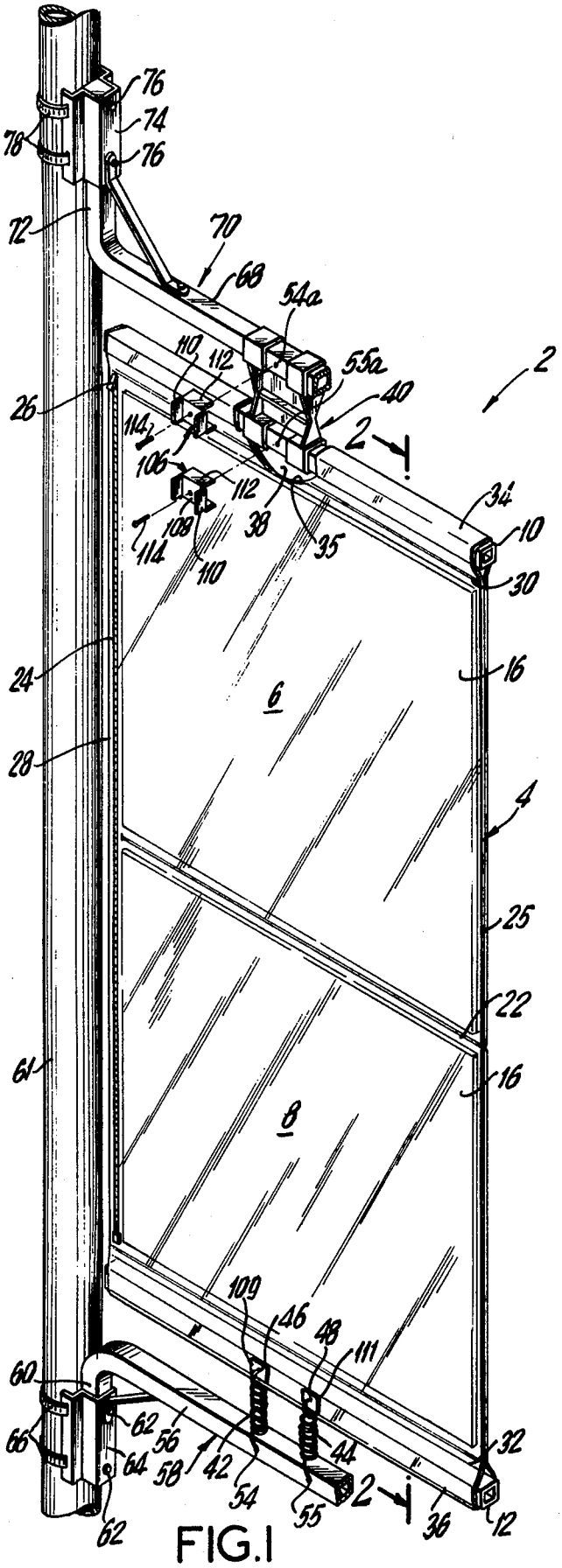
FIG. 1 is a plan view in perspective of the display device of the present invention mounted on a pole.
Figure 2:
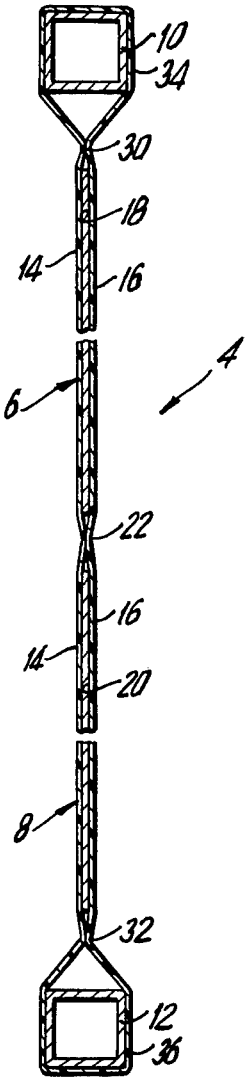
FIG. 2 is a side sectional view along the line 2—2 of FIG. 1.

In the accompanying drawing, referring particularly to FIG. 1, the improved display device of the present invention is indicated generally by the reference numeral 2. The device includes a pouch 4 for the displays and it is constructed of clear polyurethane sheeting. An upper message display panel 6 with indicia printed on both sides thereof and a similar lower message display panel 8 are shown in the pouch 4. The pouch 4 is disposed between an upper horizontal tubular arm 10 and a lower horizontal tubular arm 12 which are made of 20 gauge (0.036 thickness) steel tubing having a rectangular cross section. The pouch 4 is comprised of two separate flexible sheets of the transparent polyurethane plastic sheeting as shown in FIG. 2, the first sheet being indicated by the numeral 14 and the second sheet indicated by the numeral 16. In the embodiment illustrated, the pouch 4 is formed with two separate pockets 18 and 20, respectively, which hold the display panels 6 and 8 printed with the same or differing messages on each side. The pockets 18 and 20 are separated from each other and in part defined by a central seam 22 joining the plastic sheets 14 and 16 across the mid-line of the pouch 4 as shown in FIGS. 1 and 2. This seam is readily formed by conventional heat sealing techniques, dielectric welding, etc. It should be noted that the central seam 22 runs from the right-hand margin 25 of the sheets 14 and 18 to just short of the margin 28 on the left-hand side of the display. The zipper lock 24 serves as a common closure means for both the upper pocket 18 and the lower pocket 20 in which the display panels 6 and 8 respectively are carried. The zipper lock is provided with a conventional pull indicated at 26. While a zipper lock 24 is indicated, various snap locks or even Velcro type of closure means are suitable alternative closure means.

The upper portions of the sheets 14 and 16 are seamed together at 30 and 32 respectively by heat sealing them together. Sleeves 34 and 36 are formed at the top and bottom of the sheets 14 and 16 respectively into which, as described in greater detail below, slide the horizontal arms 10 and 12.

The center portion of the sleeve 34 is formed with an opening 38 which preferably extends slightly below the line of the seam 30 to form an opening in which the swivel structure 40 is accommodated. The edges of the sheets 14 and 16 defining opening 38 are sealed together along the arc 35 below seam line 30.

The bottom of the pouch 4 and the horizontal arm 12 are held yieldingly in place by the tension of a pair of laterally spaced tension springs 42 and 44, one end of each passing through the sleeve 36 and engaging apertures 46 and 48 respectively formed in the side of the horizontal arm 12. The opposite or lower ends of the springs 42 and 44 are secured in the apertures 54 and 55 formed in the horizontal portion 56 of the L-shaped tubular mounting frame 58. The vertical portion 60 of the frame 58 is secured to the pole 61 by conventional means such as bolts 62 passing through portion 60 and the bracket fixture 64 is held in place by the metal straps 66 encircling the pole 61.

The flexing coupling 40 which holds the upper horizontal arm 10 is secured at its upper end on the horizontal portion 68 of the L-shaped upper tubular mounting frame 70. The vertical portion 72 of the arm 70 is secured to the pole 61 in the same manner as the lower frame 58. Thus, the vertical portion 72 is secured in the fixture 74 by means of bolts 76 and in turn held in place on the pole 61 by the straps 78.

Figure 3:
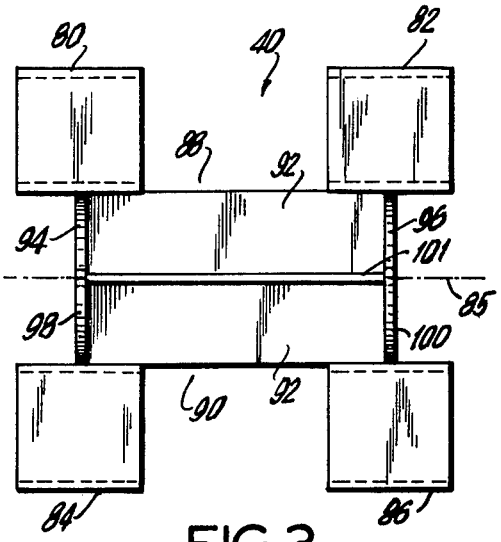
FIG. 3 is an enlarged side view of the swivel fixture of the device shown in FIGS. 1 and 2.
Figure 4:
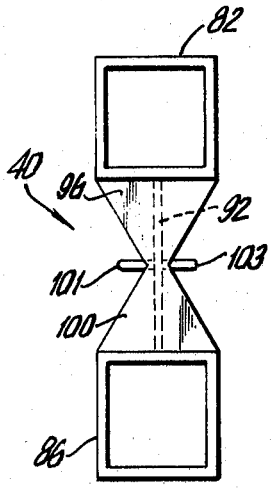
FIG. 4 is an end view of the swivel fixture shown in FIG. 3.
Figure 5:
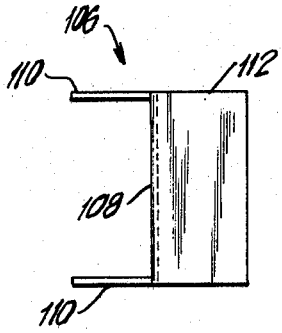
FIG. 5 is a top view of one of the brackets utilized to hold the swivel fixture in place.
Figure 6:
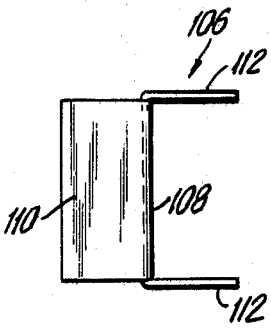
FIG. 6 is a side plan view of the bracket shown in FIG. 5.

Referring to FIGS. 3 and 4, the flexing coupling 40 is shown in greater detail. The swivel bracket 40 comprises a pair of spaced apart channels 80 and 82 of rectangular cross section dimensioned so that the inside walls fit over the corresponding exterior surfaces of the arm 68 which also has the same exterior dimensions as the arm 10.

The channels 80 and 82 are spaced as shown at 88 which corresponds in length to the width of the bracket 106 described in more detail below. The lower portion of the flexing coupling 40 is correspondingly constructed with similar channels 84 and 86 separated longitudinally by the space 90 and likewise dimensioned to slip around the horizontal arm 10. The structure 40 is provided with an upstanding vertical wall 92 between the channels 80, 82 and 84, 86 which intersects the generally triangular shaped end walls 94, 96 and 98, 100 respectively, as shown in FIGS. 3 and 4. The center of the wall 92 is optionally strengthened by ribs 101 and 103, to minimize any twisting motion and confine any flexing movement to the one plane about the longitudinal axis 85 of the fixture 40.

The flexing coupling 40 is preferably molded from polyurethane in dimension so that there is provided some flexibility about the longitudinal axis 85 running through the center of the wall 92. There is thus a slight hinge effect along an axis parallel to the arms 10 and 68.

As shown in FIG. 1, the flexing coupling 40 is slid on to the horizontal arm 10 and located at the center thereof. The bracket 40 is held in place on the arm 10 against longitudinal movement by one of the pair of brackets 106 comprised of a central wall 108, a pair of wings 110, and a pair of arms 112. The wings 110 serve to prevent lateral movement of the bracket 40 and the arms 112 stabilize the fixture 106 on the respective arm and frame, 10 and 68.

The display device of the present invention is readily transported in small containers and assembled at the point of use, usually a service station, with very little effort. The pouch itself is flexible and may be rolled or folded down to a small size. In mounting a display utilizing the device of the present invention, the pouch 4 is unrolled, the arm 10 inserted halfway through the sleeve 34 and then through the channels 84 and 86 respectively of the flexing coupling 40, then through the remainder of the sleeve 34.

The arm 12 is slid through the sleeve 36 and the ends of the springs 42 and 44 inserted into the apertures 48 and 50 through the optional reinforcement tapes 109 and 111. The assembled pouch 4 is then mounted on the mounting frame arms 56 and 68 on the pole 61.

The upper channels 80 and 82 of the bracket 40 are slid on to the horizontal portion 68 of the mounting frame 70 and secured in place with the bracket 106 through means of screws 114 which are secured in apertures 54a and 55a in the horizontal arm of the tubular mounting frame 70. If they have not been previously inserted, the display panels 6 and 8 with advertising indicia on one or both sides are inserted in the pockets 18 and 20 and the pockets sealed by the zipper lock closure 24.

As mentioned above, the pair of springs 42 and 44 are tensioned so that the display device pouch 4 can "dump" excess air by the base turning 90°.

Figure 8:
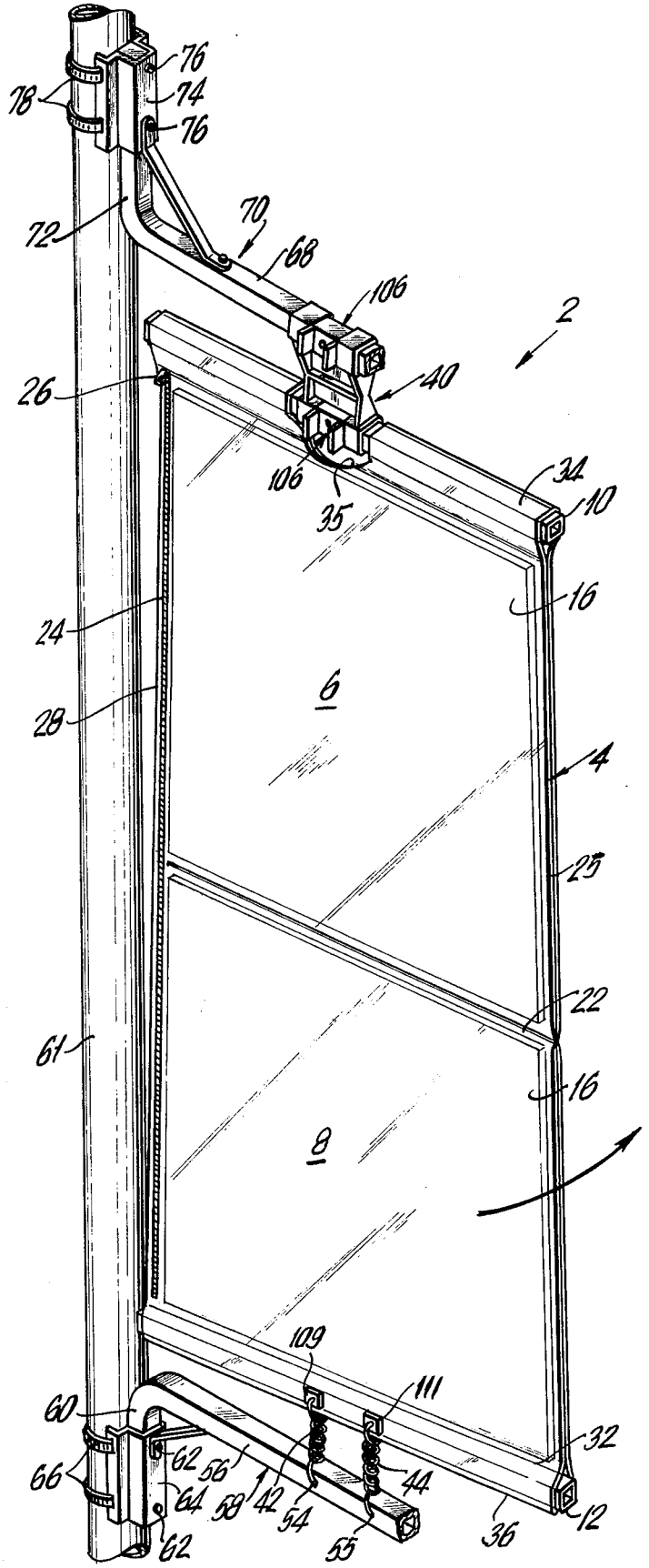
FIG. 8 is a plan view on perspective of the display device of FIG. 1 starting to twist in a wind.

FIG. 8 shows the pouch 4 of the display device 2 starting to twist in the direction indicated by the arrow because of wind force.

The bar 36 is returned to its normally parallel position with respect to the arm 56 by the tension of the springs 42 and 44. While the display pouch has been illustrated with two separate pockets 18 and 20, it is of course understood that any number of pockets may be utilized simply by adding or substracting the number of horizontal intermediate seams that are utilized. The display is conveniently and easily assembled and mounted without any special tools nor special personnel being required.

Figure 7:
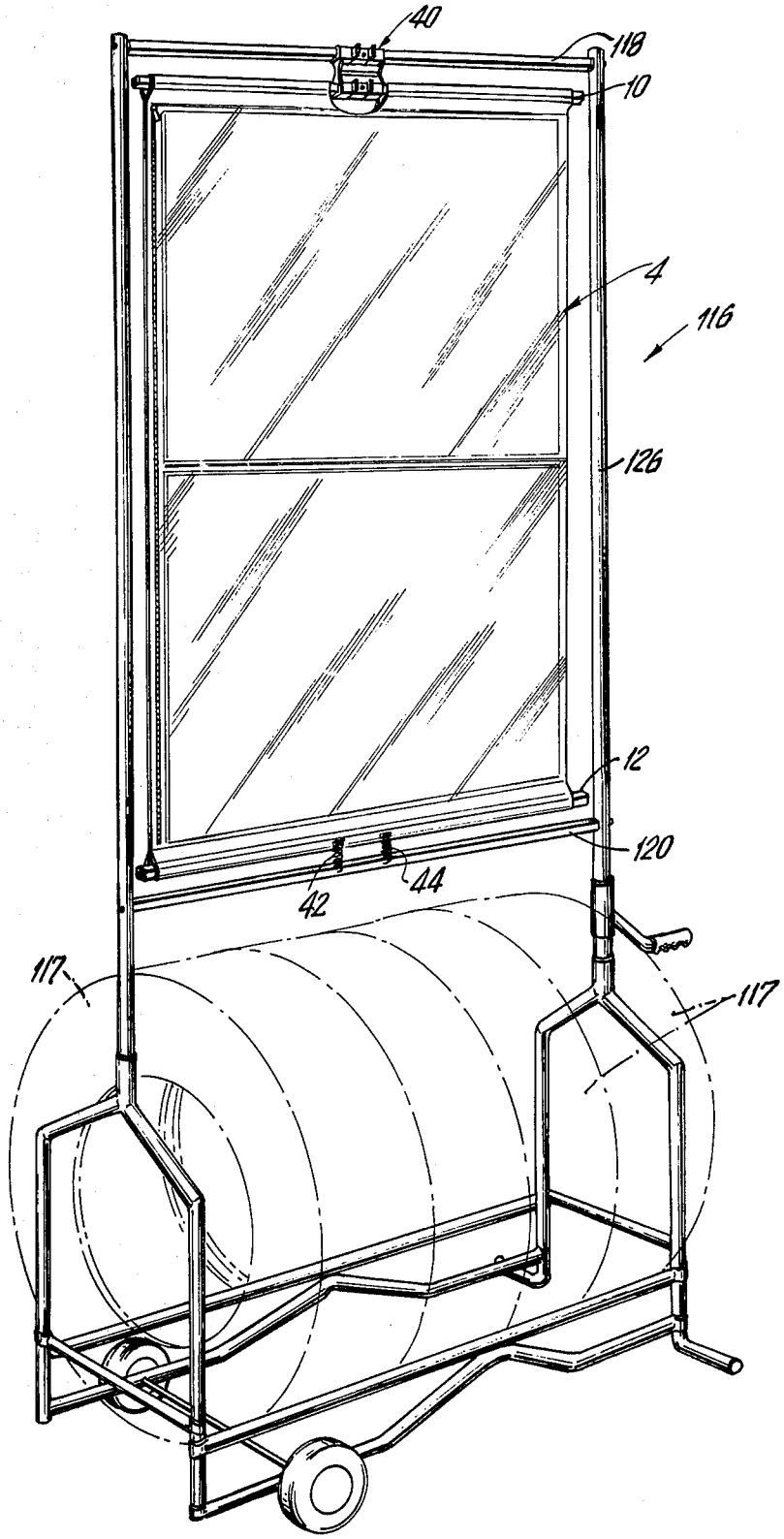
FIG. 7 is a perspective view of an alternate embodiment of the invention.

In FIG. 7, there is shown an alternate method of mounting the display device of the present invention. A storage and advertising rack 116 for automobile tires 117 is shown in which the display pouch 4 of the present invention is mounted to horizontal bars 118 and 120 forming detachable portions of the frame 126 of the tire rack. The bars 118 and 120 are of rectangular cross section and bolted or otherwise detachably secured to the frame 126.

While the invention has been explained by a detailed description of certain specific embodiments, it is understood that various modifications and substitutions can be made in any of them within the scope of the appended claims which are intended also to include equivalents of such embodiments.

What is claimed is:

1. A display device comprising a rectangular transparent plastic envelope extending generally vertically between an upper horizontal tublar arm and a lower horizontal tubular arm, said envelope being formed by two overlying sheets of transparent flexible plastic, said sheets being sealed together along their top, bottom and one side margins, reversible closure means for the other side margin, said sheets also defining horizontal enclosed sleeves at the top and at the bottom of said envelope, in which said upper and said lower tubular arms respectively are positioned, a necked out portion in the central portion of said upper sleeve to accommodate a flexing coupling, said flexing coupling having a lower portion slidingly engaging said upper horizontal tubular arm in the longitudinal central portion thereof, and an upper portion of said flexing coupling slidingly engaging a horizontal tubular mounting frame, said upper and lower portions of said flexing coupling being connected by a central portion thereof which is flexible, means for securing said flexing coupling on said upper horizontal tubular arm and said horizontal tubular mounting frame against movement thereon, and a pair of laterally spaced apart tension means extending between said lower horizontal tubular arm and a lower horizontal tubular mounting frame to normally hold said envelope in a vertical plane parallel to said upper horizontal tubular arm, but permitting said lower horizontal tubular arm to turn 90° with respect to said upper horizontal tubular arm.

2. A device as claimed in claim 1 wherein said envelope is divided into a plurality of pockets by one or more horizontal seams joining said sheets together in a straight line from said one side margin to said reversible closure means intermediate said top and bottom margins.

3. A display device as claimed in claim 1 wherein said tension means comprise a pair of spaced apart coil springs, the upper ends of which engage the lower horizontal tubular arm in apertures therein and in which the lower ends of said springs engage corresonding apertures in said lower horizontal tubular mounting frame.

4. A display device comprising a rectangular transparent plastic envelope extending generally vertically between an upper horizontal tubular arm and a lower horizontal tubular arm, said envelope being formed by two overlying sheets of transparent flexible plastic, said sheets being sealed together along their top, bottom, and one side margins, reversible closure means for the other side margin, said sheets also defining horizontal enclosed sleeves at the top and at the bottom of said envelope, in which said upper and said lower tubular arms respectively are positioned, a necked out portion in the central portion of said upper sleeve to accommodate a flexing coupling, said flexing coupling having a lower portion slidingly engaging said upper horizontal tubular arm in the longitudinal central portion thereof, and an upper portion of said flexing coupling slidingly engaging a horizontal tubular mounting frame, said upper and lower portions of said flexing coupling being connected by a central portion thereof which is flexible, means for securing said flexing coupling on said upper horizontal tubular arm and said horizontal tubular mounting frame against movement thereon, and a pair of laterally spaced apart tension means extending between said lower horizontal tubular arm and a lower horizontal tubular mounting frame to normally hold said envelope in a vertical plane parallel to said upper horizontal tubular arm, but permitting said lower horizontal tubular arm to turn 90° with respect to said upper horizontal tubular arm, and wherein said tension means comprise a pair of spaced apart coil springs, the upper ends of which engage the lower horizontal tubular arm in apertures therein and in which the lower ends of said springs engage corresponding apertures in said lower horizontal tubular mounting frame, and wherein said flexing coupling includes a pair of spaced apart rectangular cross sectional channels which slidingly engage said horizontal tubular mounting frame and a pair of lower spaced apart rectangular cross sectional channels which slidingly engage said upper horizontal tubular arm.

5. A display device as claimed in claim 4 wherein said flexing coupling includes means limiting any twisting motion of said flexing coupling with respect to the longitudinal axis of said mounting frame and wherein said flexing coupling is slightly flexible along its longitudinal axis.

6. A display device comprising a rectangular transparent plastic envelope extending generally vertically between an upper horizontal tubular arm and a lower horizontal tubular arm, said envelope being formed by two overlying sheets of transparent flexible plastic, said sheets being sealed together along their top, bottom, and one side margins, reversible closure means for the other side margin, said sheets also defining horizontal enclosed sleeves at the top and at the bottom of said envelope, in which said upper and said lower tubular arms respectively are positioned, a necked out portion in the central portion of said upper sleeve to accommodate a flexing coupling, said flexing coupling having a lower portion slidingly engaging said upper horizontal tubular arm in the longitudinal central portion thereof, and an upper portion of said flexing coupling slidingly engaging a horizontal tubular mounting frame, said upper and lower portions of said flexing coupling being connected by a central portion thereof which is flexible, means for securing said flexing coupling on said upper horizontal tubular arm and said horizontal tubular mounting frame against movement thereon, and a pair of laterally spaced apart tension means extending between said lower horizontal tubular arm and a lower horizontal tubular mounting frame to normally hold said envelope in a vertical plane parallel to said upper horizontal tubular arm, but permitting said lower horizontal tubular arm to turn 90° with respect to said upper horizontal tubular arm, and wherein said tension means comprise a pair of spaced apart coil springs, the upper ends of which engage the lower horizontal tubular arm in apertures therein and in which the lower ends of said springs engage corresponding apertures in said lower horizontal tubular mounting frame, and wherein said upper and said lower mounting frames are secured to a vertical pole wherein said spaced apart tension means comprise springs, the upper ends of which engage the lower horizontal tubular arm in apertures therein and in which the lower ends of said springs engage corresponding apertures in said lower horizontal tubular mounting frame, and wherein said flexing coupling includes a pair of spaced apart rectangular cross sectional channels which slidingly engage said horizontal tubular mounting frame and a pair of lower spaced apart rectangular cross sectional channels which slidingly engage said upper horizontal tubular arm.

* * * * *